United States Patent [19]

Venable

[11] 4,233,807

[45] Nov. 18, 1980

[54] APPARATUS FOR FORMING TWISTED CONDUCTOR UNITS

[75] Inventor: Edward R. Venable, Gwinnett, Ga.

[73] Assignee: Western Electric Company Inc., New York, N.Y.

[21] Appl. No.: 43,991

[22] Filed: May 31, 1979

[51] Int. Cl.[3] ..... H01B 13/02

[52] U.S. Cl. ..... 57/58.52; 57/58.65; 57/58.78; 57/58.83

[58] Field of Search ..... 57/58.49, 58.52, 58.65, 57/58.78, 58.83, 68, 6, 92, 102

[56] References Cited

U.S. PATENT DOCUMENTS

| | | | |
|---|---|---|---|
| 1,031,695 | 7/1912 | Delaney | 57/58.78 X |
| 2,143,203 | 1/1939 | Maxham | 57/58.78 X |
| 2,676,452 | 4/1954 | Cook . | |
| 2,773,344 | 12/1956 | Hook | 57/58.78 X |
| 2,834,178 | 5/1958 | Klein | 57/58.52 |
| 3,570,234 | 3/1971 | Friesen et al. . | |
| 3,620,001 | 11/1971 | Daker et al. . | |
| 3,969,880 | 7/1976 | Maillefer et al. | 57/58.52 X |

FOREIGN PATENT DOCUMENTS

| | | | |
|---|---|---|---|
| 969313 | 9/1964 | United Kingdom | 57/58.65 |

*Primary Examiner*—Donald Watkins
*Attorney, Agent, or Firm*—Robert B. Kennedy

[57] ABSTRACT

Apparatus is provided for forming twisted conductor units which comprises a first power transmission train 12, 14, 16, 20, 21, 35, 40 having a rotatable member 40 coupled with a power source to which a bow 72, 75 is mounted for revolutionary movement in an orbit about a reel take-up space. The apparatus further includes means 65, 68 for supporting and rotating a reel about a reel axis within the reel take-up space and a second power transmission train 30, 31, 32, 33, 48, 50, 51, 54, 55 extending through the first power transmission train rotatable member 40 coupling the reel supporting and rotating means with a power source.

7 Claims, 5 Drawing Figures

72
48
46
52
69
68
65
55
54
52
44
46
46
50
C
51
48
35
46
33
50

APPARATUS FOR FORMING TWISTED CONDUCTOR UNITS

TECHNICAL FIELD

This invention relates to apparatuses for twisting insulated conductors into twisted conductor units.

BACKGROUND OF THE INVENTION

Apparatus conventionally employed in forming twisted conductor units have an arcuate, tubular bow through which the conductors are passed that is revolved about a space in which either a set of conductor supply reels or a conductor unit take-up reel is located. Where the apparatus has the capability of forming twisted conductor units of different twist lengths, that is with different numbers of twists for a given length, it must be provided with means for varying the speed of the bow relative to the speed of advance or line speed of the conductors. This may, of course, be done by varying bow speed. However, anything less than maximum bow speed adversely limits production since the faster the bow speed the greater the number of twists which may be formed in any given period of time.

Because of the just described limitation it has been more common for the apparatuses to include means, such as a variable speed capstan, by which to vary line speed. This has performed well on twisters of the type having the conductor unit take-up reel located externally of the space about which the bow revolves. These external take-up machines however have other disadvantages and limitations. For example, multiple supply reels must be located within the bow orbit together with means for cotrolling conductor tension. This in turn mandates the use of an enlarged bow and bow orbit which, because of the increase in mass and angular acceleration forces, restricts bow speed. For these reasons it is desirable to locate the conductor supply reels externally and the twisted conductor unit take-up reel internally of bow orbit. To do so while providing the capability of producing different twist lengths would thus be quite desirable, particularly so if such could be done without locating take-up reel drive, capstan gearing, slip clutch assemblies and the like within the bow orbit. It therefore, is to this task to which the present invention is primarily directed.

SUMMARY OF THE INVENTION

In one form of the invention apparatus is provided for forming twisted conductor units which comprises a first power transmission train having a rotatable member coupled with a power source to which a bow is mounted for revolutionary movement in an orbit about a reel take-up space. The apparatus further includes means for supporting and rotating a reel about a reel axis within the reel take-up space and a second power transmission train extending through the first power transmission train rotatable member coupling the reel supporting and rotating means with a power source.

In another form of the invention apparatus is provided for forming twisted conductor units which comprises a bow drive tube coupled with a source of power for rotation about a tube axis, and a hollow bow mounted to the bow drive tube for movement about a reel take-up space. Means are provided for supporting and driving a conductor unit take-up reel about a reel axis located within the reel take-up space. A power transmission tube is coupled with a power source and supported along the bow drive tube axis for rotation about the bow drive tube axis and through which conductors may be routed into the bow drive tube and the bow. The apparatus further comprises means for coupling the power transmission tube with the conductor take-up reel support and drive means through the bow drive tube.

DETAILED DESCRIPTION

Figure 1:
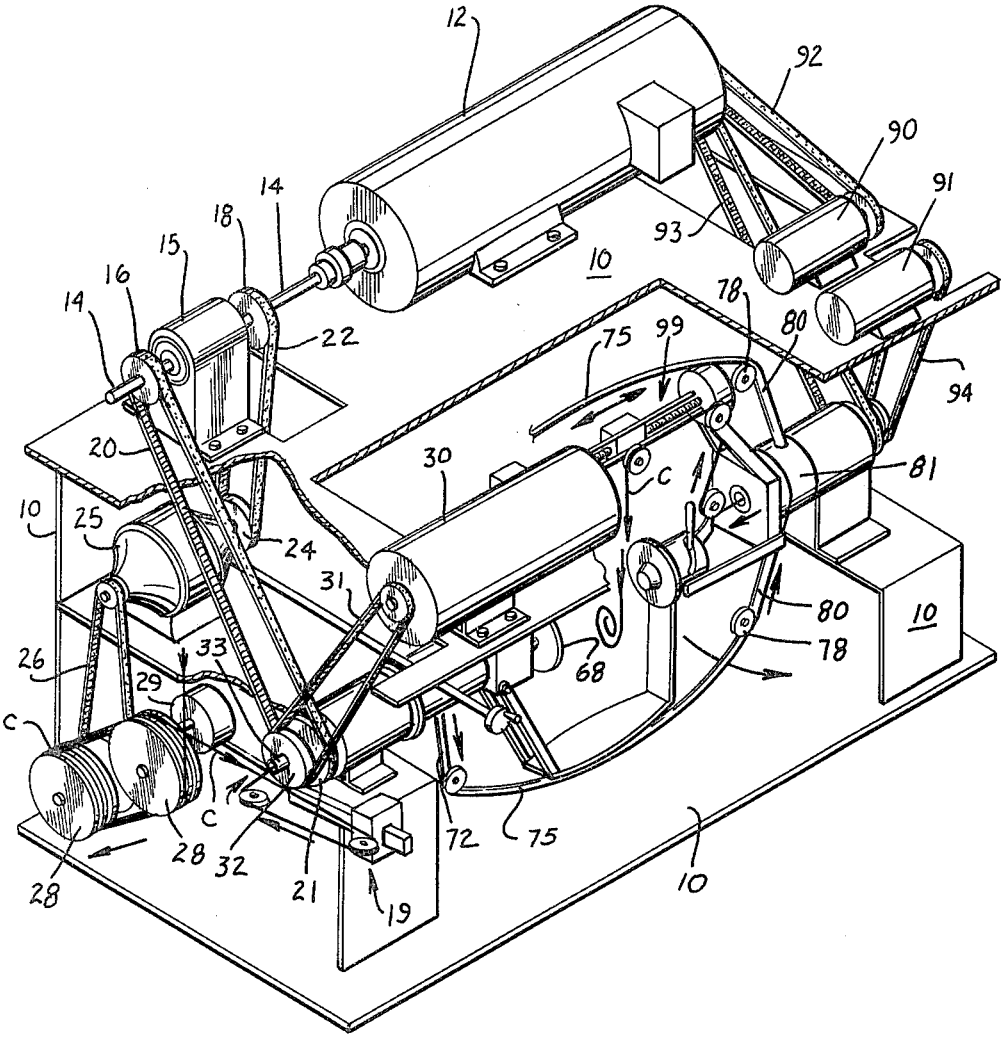
FIG. 1 is a perspective view of apparatus for forming twisted conductor units which embodies principles of the present invention.

Referring now in more detail to the drawing, there is shown in FIG. 1 apparatus for forming a plurality of insulated conductors into twisted units such as pairs and quads as for use in the telecommunications industry. The apparatus is seen to comprise a frame 10 atop which a bow drive motor 12 is mounted. To a motor output shaft 14 journaled within a bearing in bearing housing 15 are mounted two pulleys 16 and 18. A bow drive belt 20 is looped over pulley 16 and a bow drive pulley 21 while a first capstan drive belt 22 is looped over pulley 18 and another pulley 24. The pulley 24 is mounted to a shaft of a variator type gear box 25 which drives another belt 26 that drives a capstan 28 to which a tachometer 29 is coupled.

Figure 3:
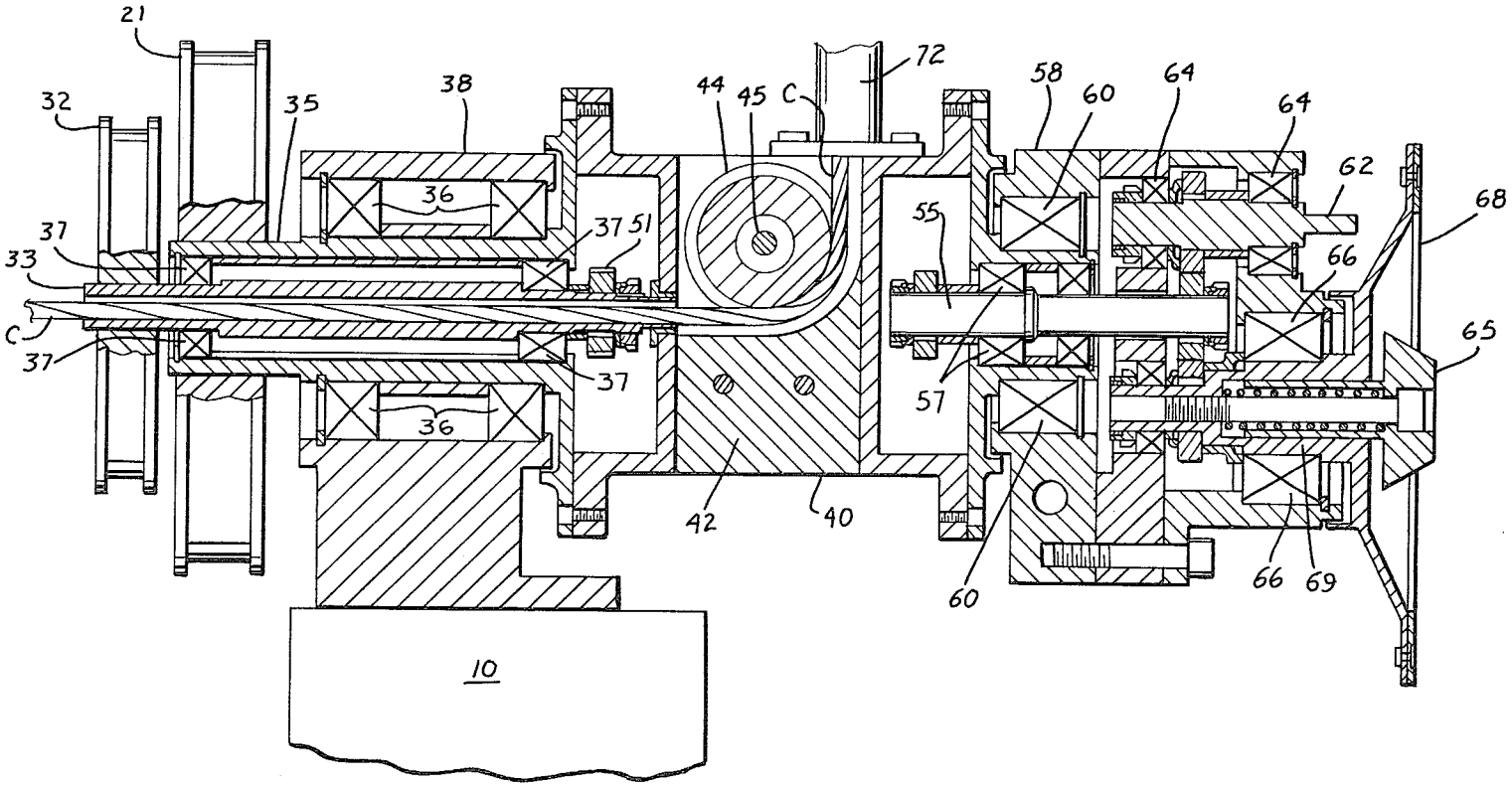
FIG. 3 is a side view, in cross-section, of portions of the power transmission trains of the apparatus shown in FIG. 1.

With continued reference to FIG. 1, the apparatus is further seen to include a take-up reel drive motor 30 mounted to frame 10 which drives a belt 31 that is looped over a take-up reel drive pulley 32. As best seen in FIG. 3, the reel drive pulley 32 itself is mounted to an elongated tube 33 while the bow drive pulley 21 is mounted to a tubular drive shaft 35 though which the elongated tube 33 coaxially extends. The drive shaft 35 is journaled within bearings 36 mounted in a bearing housing 38 atop frame 10 while the elongated tube 33 is journaled within bearings 37 that are mounted within the tubular drive shaft 35.

Figure 4:
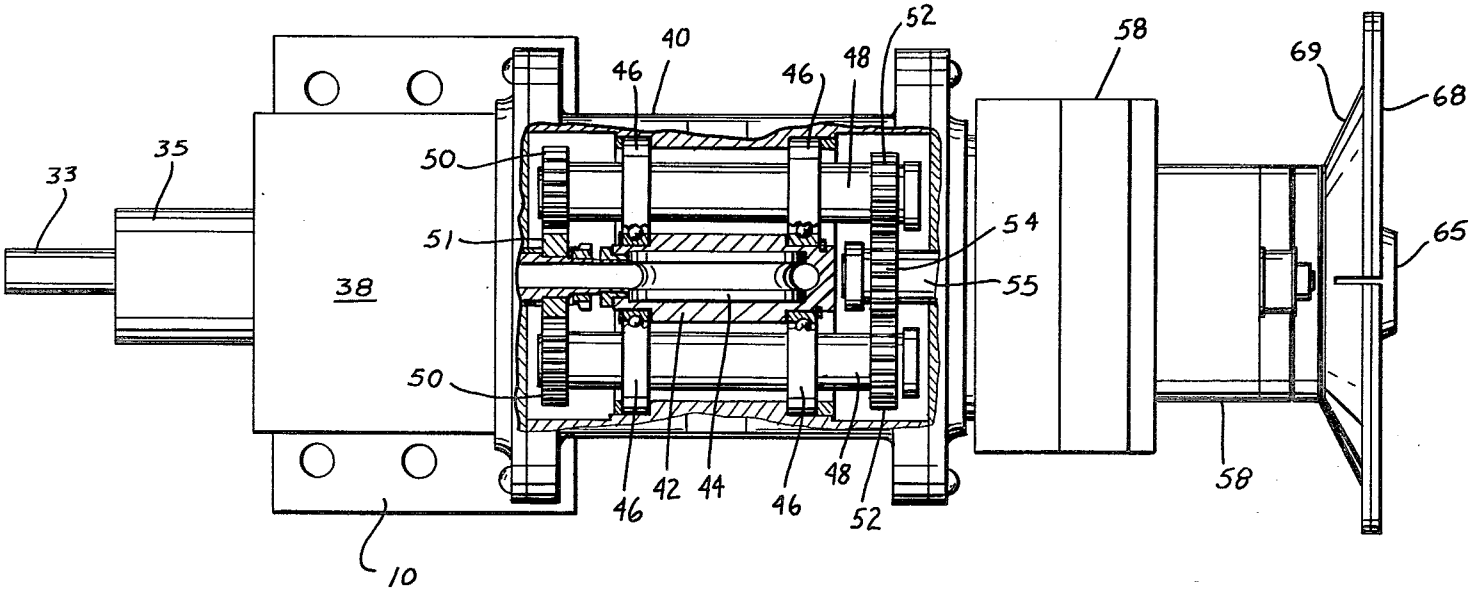
FIG. 4 is a plan view, partly in cross-section, of the assembly of power transmission trains illustrated in FIG. 3.

The tubular drive shaft is fastened to a rotatable member 40 that defines an internal cavity. A central support 42 bifurcates a portion of the internal cavity of the rotatable member 40 and supports a sheave 44 for rotation about a sheave axle 45. As may be seen in FIG. 4, four bearings 46 are mounted to internal walls of the rotatable member 40 through which a pair of auxiliary drive shafts 48 is journaled. These drive shafts are at one end coupled to the elongated tube 33 by two gears 50 mounted to the shafts which gears are in mesh with a gear 51 secured to the tube 33. At the other ends of the drive shafts 48 is similarily mounted a pair of gears 52 in mesh with a gear 54 that is rigidly mounted to another drive shaft 55.

The shaft 55 itself is journaled through bearings 57 out of the rotatable member 40 and into a cradle 58 which rotatably supports the rotatable member 40 by means of other bearings 60. Within the cradle 58 the drive shaft 55 is coupled with a wire distributor mechanism drive shaft 62 which is journaled within bearings 64 by other gearing. The drive shaft 55 is also coupled with the shaft of a reel drive arm 69 that is journaled within double roller bearing 66 carried by the cradle by other gears secured to the drive arm and drive shaft. Finally, a reel drive plate 68 is rigidly mounted to the drive arm 69, through a central aperture of which a spring-loaded arbor 65 projects.

Figure 2:
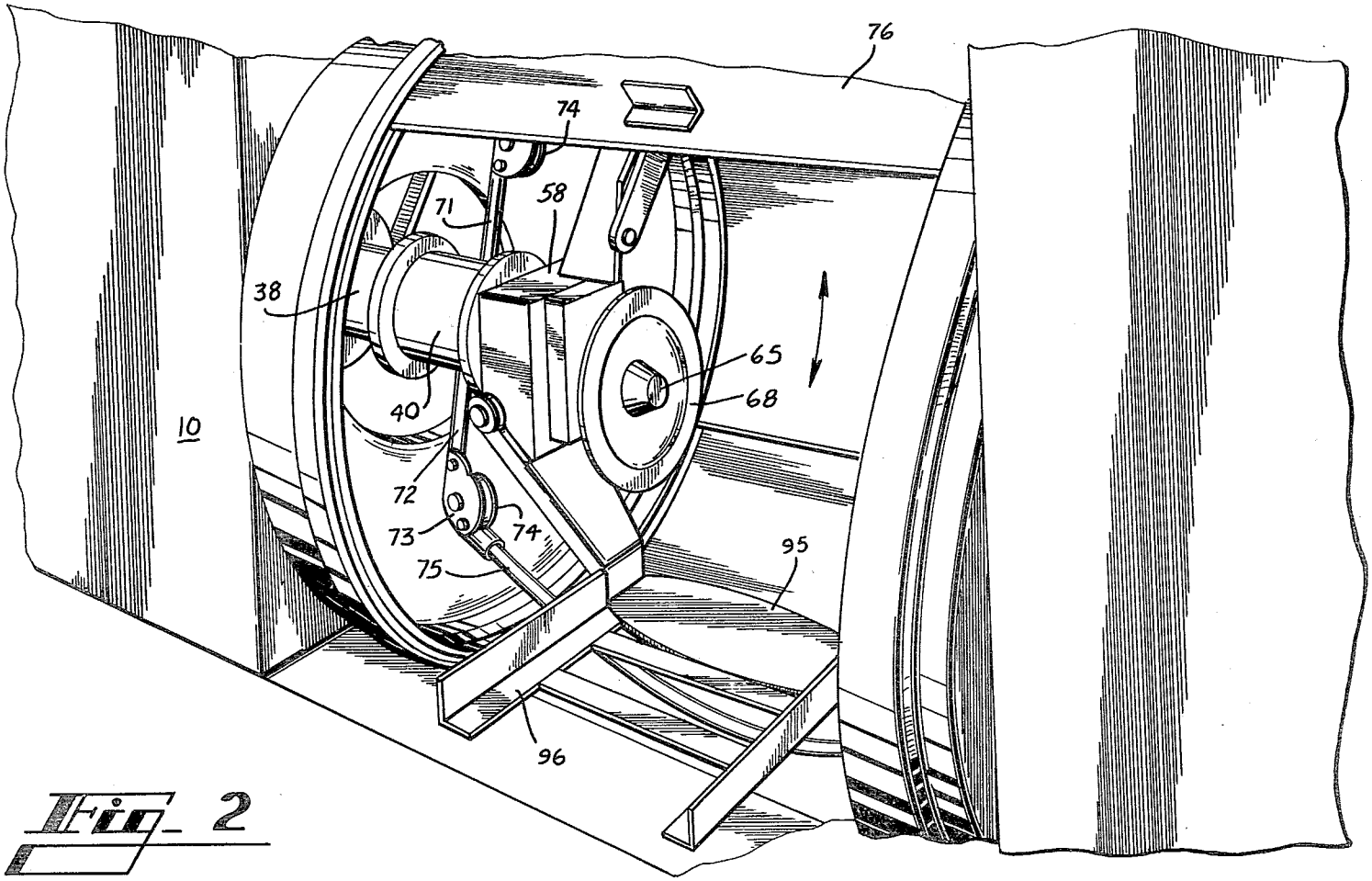
FIG. 2 is a perspective view of a portion of the apparatus of FIG. 1 located adjacent to a conductor unit take-up space in which a take-up reel may be mounted.

As best shown in FIG. 2, a pair of bow arms 70 and 71 is mounted radially to the rotatable member 40 to the ends of which elbows 73 are mounted that rotatably supports sheaves 74. Two arcuate bows 75 extend from the elbows about a reel take-up space which is exposed by the opening of a door 76 in this figure. These arcuate bows extend to the opposite side of the space from that of arbor 65 where they are also mounted to elbows which support arms 80 that are secured to another rotatable member 81 located coaxially the rotatable member 40. Again, sheaves 78 are rotatably mounted to the elbows adjacent the junction of the arcuate and radial bow members.

With reference once again to FIG. 1 another bow drive belt 93 is seen to be driven by the bow drive motor 12 which drives the rotatable member 81 to which the radial bows 81 are secured as previously described. On this side of the reel take-up space, however there need be no power transmission train for the take-up reel. An A.C. tachometer 91 is however operated by a belt 94 powered by the bow drive belt. A D.C. tachometer 90 is also driven by a belt 92 coupled with the motor 12. These tachometers and their operation are conventionally used to control the speed of the bow and take-up reel. As previously stated, another A.C. tachometer 29 is employed to control the speed of the capstans 28. A conventional conductor unit distributor mechanism 99 is also mounted within the bow orbit. And finally, as shown in FIG. 2, sling 95 is slung dependent from the cradle 58 upon which a take-up reel may be loaded by the use of a removable loading ramp 96.

In operation a take-up reel is rolled upon ramp 96 onto the sling 95. The reel is then conventionally lifted by a convergent movement of the arbor mounted to rotatable member 81 towards the arbor 65 mounted to rotatable member 40. Conductors c are then routed over the capstans 28, over a tensioning device 19, and through the elongated tube 33. From tube 33 the conductors are routed through the rotatable member 40 and through one bow, the other bow on the opposite side of the reel take-up space functioning only as a counterbalance. The conductors c are then routed through a distributor 99 and onto the take-up reel. With the reel loaded and the ramp removed door 76 may now be closed for twisting.

Figure 5:
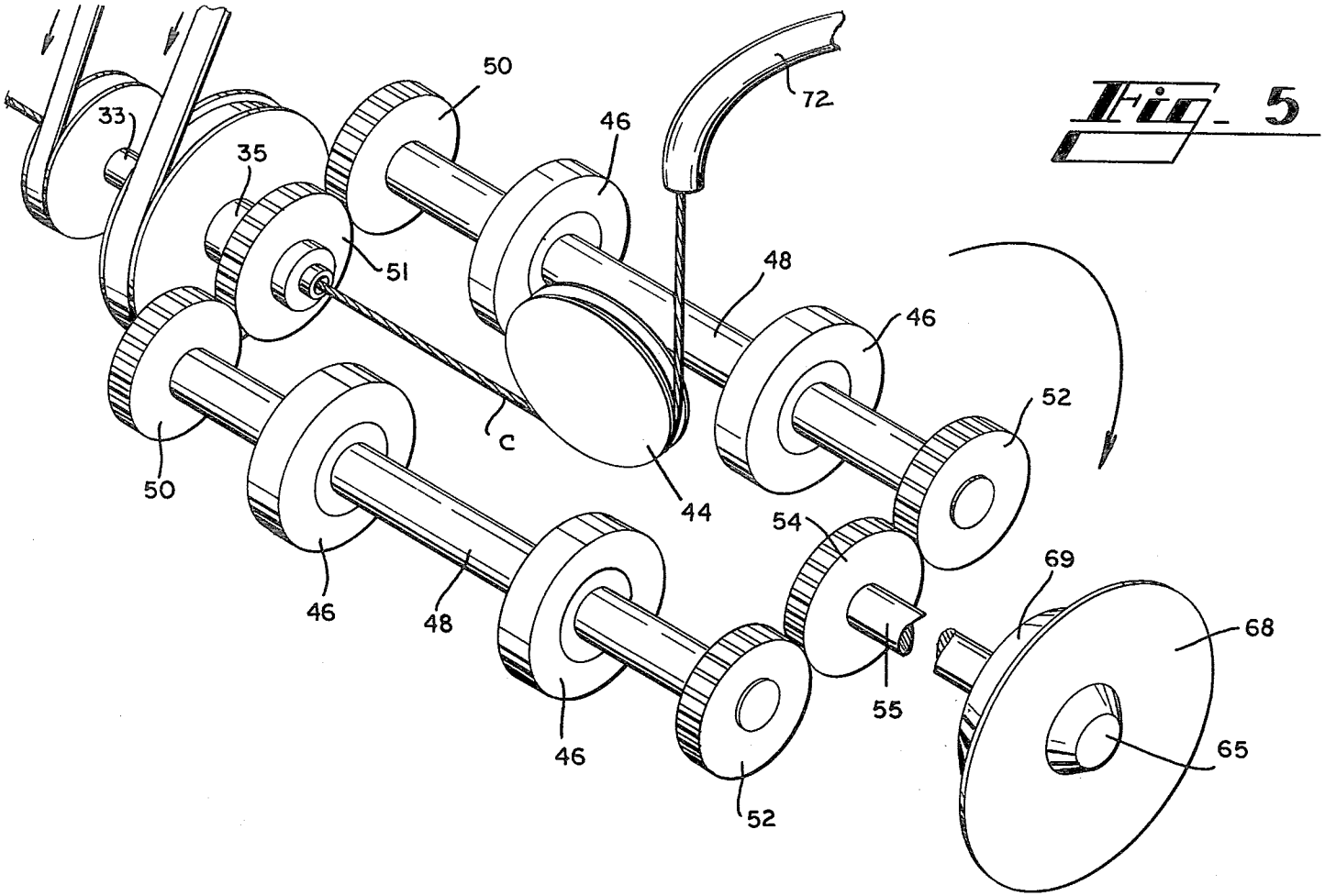
FIG. 5 is a diagrammatic view, in perspective, of the power transmission trains shown in FIGS. 2 and 3.

In performing a twisting operation the bow drive motor 12 drives the bow drive pulley 21 which in turn causes the rotatable member 40 to rotate and to revolve the bow. At the same time the take-up reel motor 30 drives the reel drive pulley 32 which causes the elongated tube 33 to rotate. Rotation of tube 33 causes gear 51 to rotate which drives gears 50. As the gears 50 are mounted to auxiliary drive shafts journaled in bearings 46 which bearings revolve with the rotary movement of rotatable member 40, the gears 50 revolve about the gear 51 in planetary fashion synchronous with the revolution of the bow. This unique action and mechanism is an important feature of the invention for it enables power to be transmitted through the rotating member 40 which drives the bow on to the drive plate 68 which supports and drives the take-up reel. In essence therefore a power train for the take-up reel is provided which passes through a portion of the power train for the bow as may be best visualized by reference to FIG. 5. As the bow and take-up reels are driven a double twist is imparted to the conductors c in the conventional manner.

It should be understood that the just described embodiment merely illustrates principles of the invention in one preferred form. Many modifications, deletions and additions may, of course, be made thereto without departure from the spirit and scope of the invention as set forth in the following claims.

What is claimed is:

1. Apparatus for forming twisted conductor units comprising a first power transmission train having a rotatable member defining a cavity coupled with a power source and being mounted for rotation about an axis; a bow mounted to said first power transmission train rotatable member for revolutionary movement in an orbit about a reel take-up space; means for supporting and rotating a reel about a reel axis within said reel take-up space; and a second power transmission train extending through said first power transmission train rotatable member cavity offset from said axis coupling said reel supporting and rotating means with a power source.

2. Apparatus for forming twisted conductor units in accordance with claim 1 wherein said second power transmission train includes a tubular member mounted for rotation about said axis and a drive shaft member mounted within said first power transmission train rotatable member offset from said axis and coupled with said tubular member.

3. Apparatus for forming twisted conductor units in accordance with claim 2 further comprising planetary gears coupling said second power transmission train tubular member with said drive shaft member.

4. Apparatus for forming twisted conductor units in accordance with claim 2 comprising a bearing mounted within and to said first power transmission train rotatable member offset from said axis through which said second power transmission train drive shaft member is journaled.

5. Apparatus for forming twisted conductor units in accordance with claim 1 further comprising a sheave mounted within said first power transmission train rotatable member for rotation about a sheave axis traversing said rotatable member axis over which conductors may pass in route from said second power transmission train tubular member in said bow.

6. Apparatus for forming twisted conductor units comprising a bow drive tube coupled with a source of power for rotation about a tube axis; a hollow bow mounted to said bow drive tube for movement about a reel take-up space; means for supporting and driving a conductor unit take-up reel about a reel axis located within the reel take-up space; a power transmission tube coupled with a power source and supported along said bow drive tube axis for rotation about said bow drive tube axis and through which conductors may be routed into said bow drive tube and said bow; and means for coupling said power transmission tube with said conductor take-up reel support and drive means through said bow drive tube comprising a drive shaft journaled through a bearing mounted within and to said bow drive tube along a shaft axis offset from said bow drive tube axis, and planetary gears located within said bow drive tube coupling said drive shaft with said power transmission tube.

7. Apparatus for forming twisted conductor units in accordance with claim 6 further comprising a sheave mounted with said bow drive tube for rotation about a sheave axis which traverses said bow drive tube and shaft axis.

* * * * *